US010786015B2

(12) United States Patent
Colombo

(10) Patent No.: US 10,786,015 B2
(45) Date of Patent: Sep. 29, 2020

(54) UNDERGARMENT FOR CHILDREN

(71) Applicant: COLPHARMA S.R.L., Parma (PR) (IT)

(72) Inventor: Arturo Colombo, Traversetolo (IT)

(73) Assignee: COLPHARMA S.R.L., Parma (IT)

( * ) Notice: Subject to any disclaimer, the term of this patent is extended or adjusted under 35 U.S.C. 154(b) by 186 days.

(21) Appl. No.: 16/071,255

(22) PCT Filed: Jan. 21, 2016

(86) PCT No.: PCT/IT2016/000014

§ 371 (c)(1),
(2) Date: Jul. 19, 2018

(87) PCT Pub. No.: WO2017/125957

PCT Pub. Date: Jul. 27, 2017

(65) Prior Publication Data

US 2020/0146363 A1 May 14, 2020

(51) Int. Cl.
*A41B 13/08* (2006.01)

(52) U.S. Cl.
CPC ..... *A41B 13/08* (2013.01); *A41B 2500/10* (2013.01)

(58) Field of Classification Search
CPC .. A41B 3/04; A41B 3/045; A41B 3/08; A41B 9/001; A41B 9/008; A41B 9/14; A41B 2500/00; A41D 11/00; A41D 13/1272
USPC ..... 2/78.1, 87, 80, 111, 404, 400, 407; 66/175–177, 19, 200; 450/95
See application file for complete search history.

(56) References Cited

U.S. PATENT DOCUMENTS 5,087,253 A * 2/1992 Cooper ..... A61F 5/4401 604/385.15
5,431,030 A * 7/1995 Ishizaki ..... A41B 9/00 66/176
6,272,888 B1 8/2001 Fujita et al.
2004/0237599 A1* 12/2004 Kondou ..... D04B 1/18 66/202
2006/0048495 A1* 3/2006 Threlkeld ..... D02G 3/443 57/210
2006/0180067 A1 8/2006 Yamazaki et al.
2007/0056076 A1 3/2007 Gaugler et al.
2012/0180188 A1* 7/2012 Banica ..... A41B 13/08 2/80
2012/0297518 A1* 11/2012 Aiken ..... A41B 13/005 2/80

(Continued)

FOREIGN PATENT DOCUMENTS

CN 1206441 A 1/1999
CN 1723305 A 1/2006

(Continued)

*Primary Examiner* — Katherine M Moran
(74) *Attorney, Agent, or Firm* — Pearne & Gordon LLP

(57) ABSTRACT

Undergarment for children comprising a babygrow (2) with fittability 0-3 years of age; in said babygrow (2) a neck (21)-crotch (22) directional line is defined; more than 90% of the weight of the fabric of the babygrow (2) is in cotton. At least 70% of the outer surface of the babygrow (2) has ribs (7) extending transversely to the neck-crotch directional line (3). The ribs (7) permit an elongation of more than 40% along the neck-crotch directional line (3) following the application of a force that is less than or equal to 5 Newton along said directional line (3).

9 Claims, 3 Drawing Sheets

(56) References Cited

U.S. PATENT DOCUMENTS

2015/0272228 A1* 10/2015 Penner ..... A41B 13/08
2/80

FOREIGN PATENT DOCUMENTS

| | | | |
|---|---|---|---|
| CN | 104379028 | A | 2/2015 |
| EP | 0465130 | A1 | 6/1991 |
| JP | 1992257342 | A | 9/1992 |
| JP | 3125868 | U | 9/2006 |
| WO | 2012138993 | A2 | 10/2012 |

* cited by examiner

UNDERGARMENT FOR CHILDREN

FIELD OF THE INVENTION

The object of this invention is a single-size undergarment for children with fittability of 0-3 years of age and a method for making the same.

PRIOR ART

It is known that children from 0 to about 3 years of age wear a particular undergarment known as a babygrow. The babygrow is worn from birth and is normally used for as long as the child wears diapers.

The babygrow is put on the child by inserting first the head and then the arms. Next, the babygrow is closed by buttons, which are often automatic, between the legs of the child (known as the "crotch") above the diaper.

This undergarment for children is usually made with special features in the neck to facilitate inserting the head of the child such as:

an opening at the shoulder with closing buttons;

an opening at the shoulder with overlapping fabric, also known as a halter top.

It is also known that children from 0 to 3 years of age grow very quickly and thus clothes, and in particular undergarments, have to be changed with a certain frequency.

For this reason, babygrows are sold in about 8 to 10 sizes that range from neonate (50-55 centimetres in height) to 36 months of age (98-100 centimetres in height).

The babygrows are produced and purchased mainly in cotton because it is considered that this "natural" fibre is well tolerated by the child's skin.

Current babygrows involve the parents in continuously changing the undergarment for the child with considerable expense for the purchase, increasing the environmental problems connected with the manufacture and disposal of these products.

Certain single-size undergarments for children from 0 to 3 years of age that are made of synthetic microfibre with seamless technology that is able to meet the necessary elasticity needs are known at the moment. Nevertheless, the product is not popular with many parents because of the high cost and the fear that such a material may not be well tolerated dermatologically by the delicate and sensitive skin of a neonate.

OBJECT OF THE INVENTION

In this case, the technical task on which this invention is based is to propose an undergarment and a manufacturing method that enables an undergarment to be made of a material that is dermatologically tolerated by all children that permits fittability from 0 to 36 months of age.

The defined technical task and the specified objects are substantially achieved by a garment and a manufacturing method comprising the technical features set out in one or more of the attached claims.

BRIEF DESCRIPTION OF THE DRAWINGS

Further features and advantages of the present invention will become clearer from the illustrative and thus non-limiting description of a preferred but non-exclusive embodiment of a garment, as illustrated in the attached drawings in which:

FIG. 3 shows a stitch and FIG. 4 shows a section of a part of this stitch carried out along a plane that is orthogonal to the sheet;

DETAILED DESCRIPTION OF PREFERRED EMBODIMENTS OF THE INVENTION

In the attached figures, with reference number 1 an undergarment for children is indicated comprising a babygrow 2. This babygrow has fittability 0-3 years of age.

The babygrow is single-size owing to the significant fittability.

In said babygrow 2 a neck 21-crotch 22 directional line 3 is defined.

Figure 2:
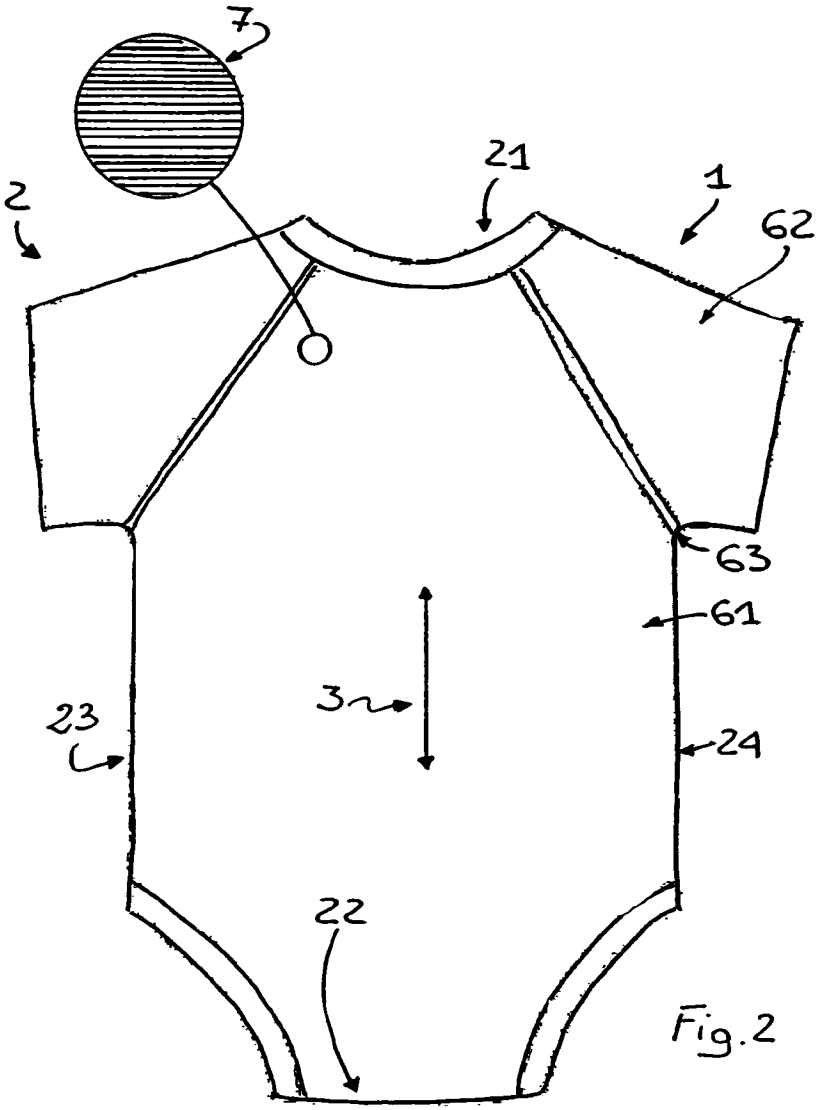
FIGS. 1 and 2 show two alternative views of a garment according to the present invention with a corresponding enlargement.
Figure 1:
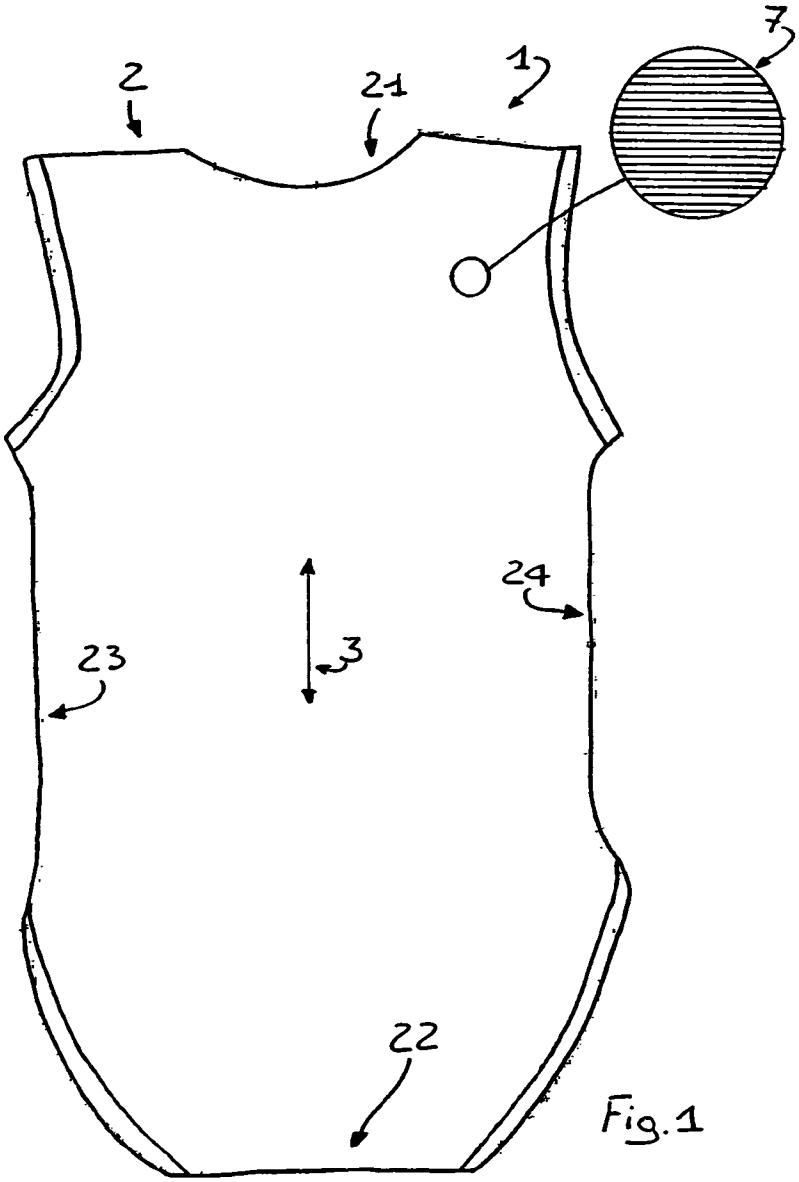
Figure 3:
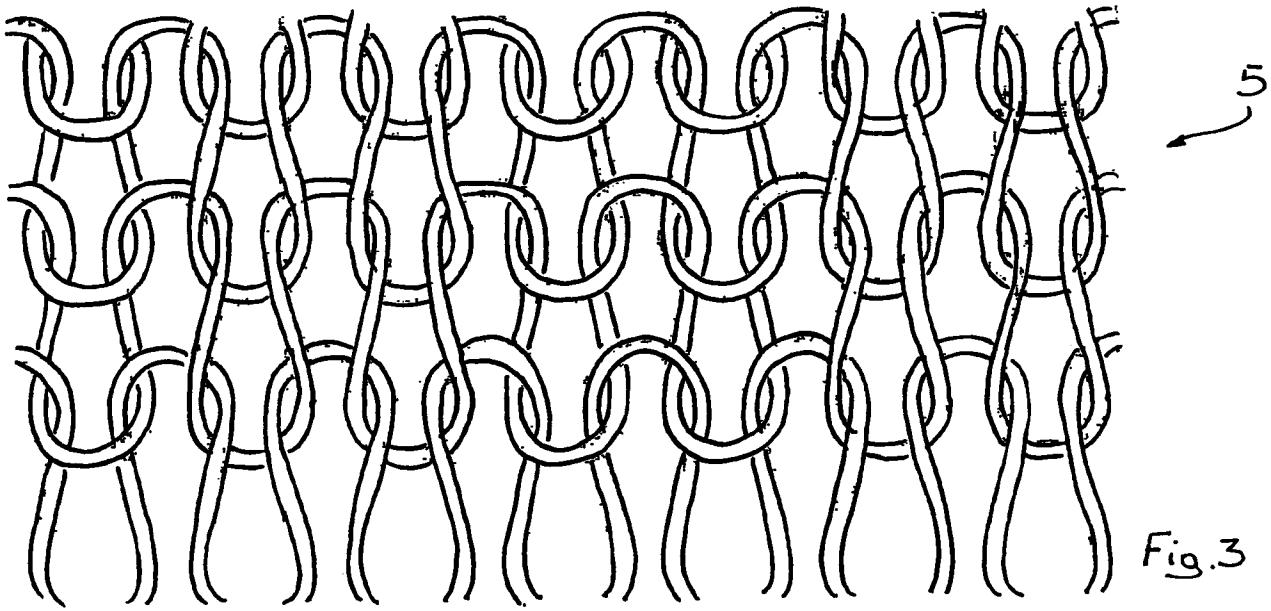
FIGS. 3 and 4 show two schematic details of the structure of the fabric of a garment according to the present invention; in particular
Figure 4:
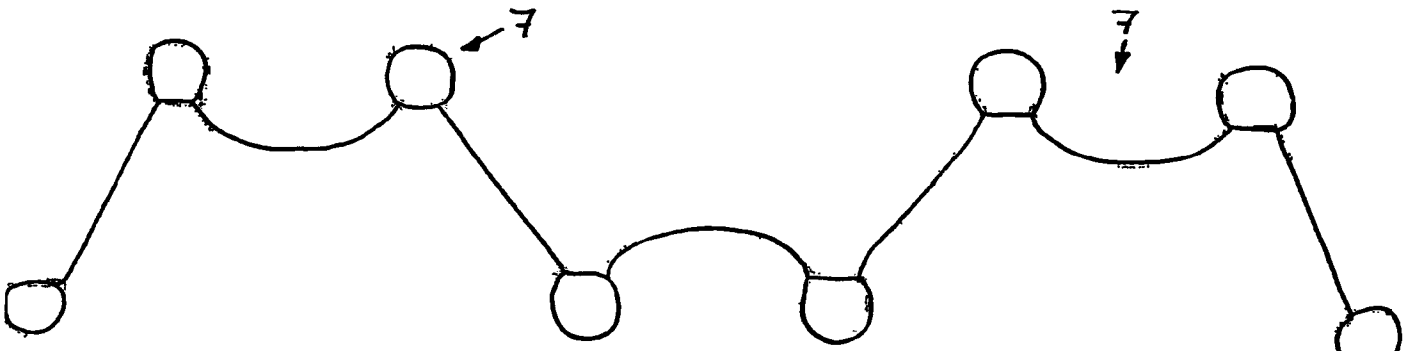

More than 70%, advantageously more than 90%, of the weight of the fabric of the babygrow 2 is made of cotton. In the preferred solution more than 95% of the weight of the fabric of the babygrow 2 is made of cotton. At least 70% of the outer surface of the babygrow 2 has ribs 7 extending transversely to the neck-crotch directional line 3. The weft of the babygrow 2 identifies said directional line 3. Such ribs are typically microribs. When the fabric is not spread out the ribs are typically not visible to the naked eye (or are not easily visible to the naked eye). For this reason, in FIGS. 1 and 2 an enlargement emphasises the ribs.

Opportunely, the ribs 7 permit an elongation of more than 40% along the neck-crotch directional line 3 following the application of a force that is less than or equal to 30 Newton along said directional line 3. Opportunely, an elongation of more than 40% is obtained along the neck-crotch directional line 3 following the application of a force that is equal to 10 Newton (preferably 5 Newton) along the neck-crotch directional line 3.

A traditional cotton babygrow would require a force of more than 50 Newton to obtain an elongation of little more than 20%.

Owing to this deformation the garment 1 can thus adapt to the growth of a child.

In order to run this test, the garment is not worn; the front and back of the babygrow are then made to overlap (the garment thus has a substantially two-dimensional development: height, width).

The elongation along the neck-crotch directional line 3 is advantageously detected according to a test method conforming to standard UNI EN 14704-1; 2005.

Opportunely, an elongation is also permitted that is greater than 20% along an orientation that connects the two lateral sides of the babygrow 2 following the application of force that is less than or equal to 5 Newton along this orientation (this orientation is the warp orientation). This elongation along the width of the babygrow is however less important in order to ensure fittability of the garment for the first three years.

The ribs 7 comprise stitches 5. The threads that define the ribs define stitches that are interconnected between one another.

Such stitches mainly consist of cotton threads.

The stitches comprise in addition to the cotton also bare elastomer threads that are advantageously not braided with other threads.

Opportunely, this elastomer could comprise polyurethane (for example Elastan) or polybutylene terephthalate, polyolefin elastomer, advantageously between 20 and 40 D. Tex.

The fact that the Elastan threads are not braided enables a fabric with excellent elasticity along two directions that are orthogonal to one another to be obtained. In this way elasticity is improved not only along the neck-crotch directional line 3 but also along a directional line that extends between the two flanks 23, 24 of the babygrow. This is obtained despite not performing warp knitting with linear machines of the Raschel type. Opportunely, such stitches have thickening comprised between 8 and 32 ribs per $cm^2$, preferably comprised between 12 and 20 ribs per $cm^2$.

In one particular solution more than 90% and less than 100% of the weight of the fabric of the babygrow 2 could be made of cotton.

The percentage of elastomer could also be further reduced in relation to the cotton yarn twisting preparation. Similarly, the percentage of cotton can be increased to 99% in relation to the denier rating of the elastomeric thread.

In one particular constructional solution the babygrow 2 is an assembly of at least a first and a second piece 61, 62.

For example, the first and the second piece 61, 62 can be a frontal part and a rear part of the babygrow or one of the pieces can be a sleeve.

The babygrow comprises a sewing thread 63 of the first and second piece 61, 62. This thread is advantageously made of polybutylene terephthalate (that has an elongation comprised between 48% and 72%). This material also has great resistance to uric acid (and this is important as the garment is intended for children between 0 and 3 years of age).

Opportunely, the sewing thread 63 of the first and second piece 61, 62, at least in an undeformed configuration of the babygrow, extends along a line that gathers at least in part on itself (owing to the elasticity of the thread) and which can stretch to facilitate possible extensions of the babygrow 2. Advantageously, the neck of the babygrow is round-neck. It has no opening on the shoulder (closable for example by buttons or provided with overlapping fabric, known as a halter top). Opportunely, the babygrow 2 comprises a sleeve of Raglan type. The above is important because alternatively the neck would risk opening when the garment is tensioned along the neck-crotch directional line 3 (or rather along the shoulder-crotch directional line) to exploit the extension thereof.

The Raglan sleeve, without stitching on the upper point of the shoulder, avoids friction points caused by the stitching.

The round neck has great elasticity to be able to ensure a horizontal opening comprised between 22 and 30 cm so as to enable the head of a child of three to be inserted.

Figure 5:
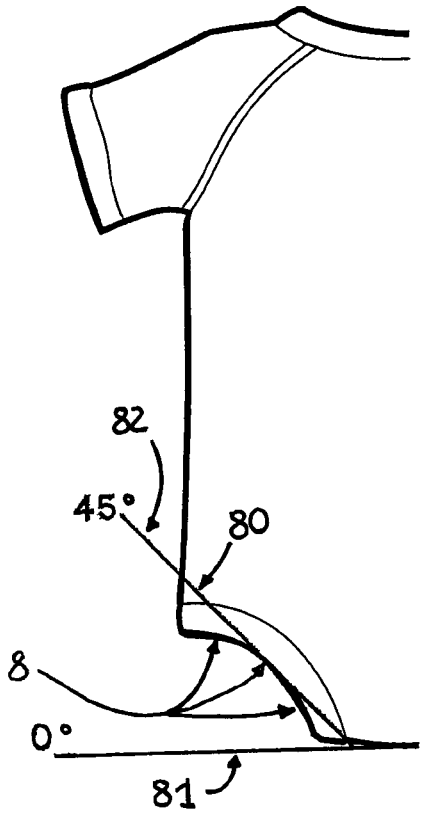
FIG. 5 shows a front view of a part of the garment according to the present invention.

The ribs 7 are repeated alongside along the neck-crotch directional line 3. Advantageously, the tilt 80 of the leg opening 8 of the babygrow 2 is less than or equal to 45°. With reference to FIG. 5 an angle 80 comprised between a first and a second straight line 81, 82 is less than or equal to 45°, in which:

- the first straight line 81 is orthogonal to the neck-crotch directional line 3;
- the second straight line 82 is tangent to the leg opening 8 at a point that is half way on an arch defined by the front part of the leg opening 8.

In this manner the babygrow 2 enables an underlying diaper to be covered, by preventing the diaper from showing, also taking account of the elongation along the neck-crotch directional line 3.

The object of the present invention is also a method for making a garment that has one or more of the features disclosed previously.

Opportunely, the method comprises the following steps:

- obtaining a tube by means of a circular machine (suitably but not necessarily this can be through an E. T. R. Rib Machine—Electronic Transfer Rib Machine—);
- cutting said tube (suitably along a generator line), obtaining a web;
- obtaining from said web a frontal portion of the babygrow, said frontal portion extending between the neck and the crotch.

The step of obtaining said frontal portion comprising the step of cutting the frontal portion in such a manner that the ribs of the web extend orthogonally to the neck-crotch directional line 3 of said frontal portion. A "weft" cut is thus made. This enables the elasticity in the thickening of the ribs to be optimised.

The method then involves obtaining a rear portion of the babygrow and assembling the rear portion with said frontal portion.

Advantageously, the rear portion is obtained from the same web from which the frontal portion is obtained. In one particular solution an originally distinct zone could be assembled that involves one or more arms.

The invention so conceived enables multiple advantages to be obtained. Above all, it enables a single-size babygrow to be obtained that can be used by a child from birth to 36 months but which at the same time is really appreciated by parents because it is a natural material that absorbs sweat well, which is also well tolerated by even the most delicate skins. This permits a significant cost saving for parents who would otherwise have to change the babygrow with significant frequency to accompany the growth of the child.

This is obtained by a particular composition of the babygrow associated with a particular fabric structure (with ribs that extend in width). One aspect of interest is also the use of a specific thread with a high modulus of elasticity for making seams.

The invention so conceived can be subject to numerous modifications and variations, all of which fall within the scope of the inventive concept that characterises the invention. Further, all the details are replaceable by other technically equivalent elements. In practice, all the materials used and the dimensions can be of any type, according to the need.

The invention claimed is:

1. Undergarment for children comprising a babygrow (2) with fittability 0-3 years of age; said babygrow having a neck (21) and a crotch (22), in said babygrow (2) a neck (21)-crotch (22) directional line is defined;

characterised in that more than 70% of a weight of a fabric of the babygrow (2) is cotton; at least 70% of the outer surface of the babygrow (2) having ribs (7) extending transversely to the neck-crotch directional line (3); said ribs (7) permitting elongation of more than 40% along the neck-crotch directional line (3) following the application of a force that is less than or equal to 30 Newton along the directional line (3);

the neck of the babygrow being round-neck and not having opening on the shoulder provided with overlapping fabric; the babygrow (2) is an assembly of at least a first and a second piece (61, 62); the babygrow comprising a sewing thread (63) of the first and second piece (61, 62);

said thread, at least in an undeformed configuration of the babygrow, extending along a line that gathers on itself because of an elasticity of the thread and which can extend to facilitate possible extensions of the babygrow (2).

2. Undergarment according to claim 1, characterised in that more than 95% and less than 100% of the weight of the fabric of the babygrow (2) is made of cotton.

3. Undergarment according to claim 1, characterised in that said ribs (7) comprise stitches (5) with thickening comprised between 8 and 32 ribs per $cm^2$.

4. Undergarment according to claim 3, characterised in that said stitches (5) comprise in addition to cotton also bare elastomer threads.

5. Undergarment according to claim 1, characterised in that the babygrow (2) is an assembly of at least one first and second piece (61, 62); the babygrow comprising a sewing thread (63) for sewing the first and second piece (61, 62), which is made of polybutylene terephthalate.

6. Undergarment according to claim 1, characterised in that the neck of the babygrow has no type of opening on a shoulder.

7. Undergarment according to claim 1, characterised in that said ribs (7) extend alongside one another and the ribs are repeated alongside one another along the neck-crotch directional line (3).

8. Undergarment according to claim 1, characterised in that a tilt (80) of a leg opening of the babygrow (2) is less than or equal to 45°.

9. Method for making an undergarment according to claim 1, characterised in that it comprises the following steps:

obtaining a tube by a circular machine;

separating said tube, obtaining a web;

obtaining from said web a frontal portion of the babygrow, said frontal portion extending between the neck and the crotch; the step of obtaining said frontal portion comprising the step of cutting the frontal portion so that the ribs of the web extend orthogonally to the neck-crotch directional line (3) of said frontal portion;

obtaining a rear portion of the babygrow and assembling the rear portion with said frontal portion.

* * * * *